US005867869A

United States Patent [19]

Garrett et al.

[11] Patent Number: 5,867,869

[45] Date of Patent: Feb. 9, 1999

[54] PRESSURE HINGE DEVICE FOR GLASS DOOR OR PANEL

[75] Inventors: Rodney G. Garrett, Fort Madison; Anthony P. Lambros, Keokuk, both of Iowa

[73] Assignee: Chmi, Keokuk, Iowa

[21] Appl. No.: 319,468

[22] Filed: Oct. 6, 1994

[51] Int. Cl.[6] ..... E05D 11/10; E05D 5/00

[52] U.S. Cl. ..... 16/252; 16/332; 16/334; 16/382

[58] Field of Search ..... 16/292, 293, 334, 16/344, 303, 304, 286, 252, 332, 327, 390, 331

[56] References Cited

U.S. PATENT DOCUMENTS

| | | | |
|---|---|---|---|
| 4,491,355 | 1/1985 | Marinoni | 16/332 |
| 5,079,798 | 1/1992 | Burke et al. | 16/252 |
| 5,297,313 | 3/1994 | Brin | 16/252 |
| 5,513,420 | 5/1996 | Kennedy | 16/252 |

FOREIGN PATENT DOCUMENTS

| | | | |
|---|---|---|---|
| 2342392 | 9/1977 | France | 16/331 |
| 1965603 | 12/1970 | Germany | 16/352 |
| 1965604 | 12/1970 | Germany | 16/352 |
| 376389 | 5/1964 | Switzerland | 16/332 |
| 404854 | 1/1934 | United Kingdom | 16/322 |

OTHER PUBLICATIONS

European Patent No. 599,254 A1, published: Jun. 1994 Inventor: Karl Loggen, 3 pp. Spec., 1 sheet drawing.

C. R. Lawrence, Lalique Series, Copyright 1994, C.R. Lawrence Co., Inc. 1 Pg.

C. R. Lawrence, Petite Series, Copyright 1994, C.R. Lawrence Co., Inc. 1 Pg.

C. R. Lawrence, Estate Series, Copyright 1994, C.R. Lawrence Co., Inc. 1 Pg.

C. R. Lawrence, Geneva Texas Series, Copyright 1994, C.R. Lawrence Co., Inc. P. 7.

C. R. Lawrence, Prima Series, Copyright 1994, C.R. Lawrence Co., Inc., P. 9.

C. R. Lawrence, Junior Geneva Series, Copyright 1994, C.R. Lawrence Co., Inc. 1 Pg.

C. R. Lawrence, Geneva Series, Copyright 1994, C.R. Lawrence Co., Inc., P. 5.

C. R. Lawrence, Elite Series, Copyright 1994, C.R. Lawrence Co., Inc., 1 Pg.

C. R. Lawrence, Zurich Series, Copyright 1994, C.R. Lawrence Co., Inc., P. 3.

C. R. Lawrence, Glass Hinges & Glass Clamps, Copyright 1994, C.R. Lawrence Co., Inc., 1 Pg.

*Primary Examiner*—Chuck Mah
*Assistant Examiner*—Donald M. Gurley
*Attorney, Agent, or Firm*—Zarley, McKee, Thomte, Voorhees, & Sease

[57] ABSTRACT

This invention relates to a means and method of hinging a glass door panel on an adjoining wall, either glass or non-glass. This invention uses a friction clamping method to secure the glass between surfaces lined with flexible gaskets. When torque is applied to the clamp screws, the flexible gaskets swell laterally to provide a large gripping surface area. The invention also includes an actuating mechanism that allows for wide range of rotation with absolute reputability. The actuating mechanism utilizes a main pivot roller that incorporates two indexing detents. A spring loaded sub pin roller rotates along the periphery of the main pivot roller providing a consistent index to each of the two detents.

16 Claims, 6 Drawing Sheets

PRESSURE HINGE DEVICE FOR GLASS DOOR OR PANEL

BACKGROUND OF THE INVENTION

A. Field of the Invention

This invention relates generally to hinges, and in particular to a pressure hinge that can be used to hinge a glass panel door to a glass panel wall or to a wall of other material, shape, or orientation with respect to the door.

B. Problems in the Art

The need for a device to hinge glass, and particularly unframed glass, was largely spawned by the rising popularity of frameless all-glass shower enclosures. A variety of devices have been used to hinge glass panels. Continuous improvements have been made in an effort to design a hinge that minimizes fabrication and installation costs, allows for a wide range of rotation with consistent return to its original position, is of high quality, and is aesthetically pleasing to the user.

It is not a trivial matter to design a hinge that meets these goals. Glass is relatively heavy. It is not easily modified, for example, by drilling holes through it or even cutting into it.

One device commonly used is a hinge that fastens to the glass through holes drilled in the glass. Specifying that holes be made in the fabricated product is undesirable. Such a design is less flexible in that once the holes are drilled, the exact location of the hinge cannot easily be adjusted. Consequently, greater accuracy by the installer is required in the field, measuring and installing of the fabricated glass. Also, the fabricator and temperer of the glass must be accurate and capable of great detail. Thus, using a hinge that requires holes in the glass results in a more expensive process. Holes can also present potential breakage problems.

Other hinge designs clamp onto the glass to eliminate drilling through the glass. These hinges, however, suffer from a variety of problems. One common problem in the prior art is the inability of the device to maintain a secure grip on the glass. If the clamp on the hinge does not firmly grip the glass, loosening or misfitting can occur. If additional torque is applied to the clamp screws to attempt to establish a secure grip, more stress and strain is placed on the glass panel. Furthermore, applying additional torque results in a more difficult, time consuming and expensive installation.

A second problem involves the inability of the prior art to consistently return a glass door panel during rotation to certain predetermined angles. It is frustrating to a user to open and close a glass door which does not index with such absolute repeatability.

Another problem in the prior art concerns the design of internal parts of the hinge. Many of the devices have internal parts that rub or experience forces which tend to wear out their internal mechanisms. When the internal mechanism begins to wear, the hinge can lose its accuracy and become less effective.

Most hinges currently used are made of a non-corrodable metal (e.g., brass, stainless steel, aluminum) because of strength and durability, and because the hinges will constantly be exposed to moisture and humidity. The prior art is plagued, however, by grain structure flaws. It is commonplace to utilize forging methods to manufacture a glass door hinge. Inherent in such a method are flow control problems that result in grain structure flaws. These structural flaws weaken the hinge body with the hinge tending to lose its accuracy and become less effective.

Another widespread problem exists when the prior art is used to hinge a glass door panel to a wall. Typically, the base plate mounted on the wall and the main body of the hinge are designed with abutting flat surfaces. This design is susceptible to a rocking motion when the hinge rotates, which tends to loosen the base plate screws under an axial load.

Finally, the prior art tends to suffer from a lack of aesthetic appeal. Glass panels and doors are often incorporated in designs for their aesthetic qualities. A hinge that subtracts from the aesthetic appeal of its environment may not be desired even when functionally adequate. For example, if the environment is a frameless all-glass shower enclosure, consumers are likely to prefer a metal hinge with a lustrous finish over a hinge with a dull finish or a hinge with a minimum number of protrusions or visual interruptions.

All the prior art suffers from one or more of the aforementioned problems. Thus, there is a need in the art for a hinge that can firmly grip glass surfaces in a way that minimizes costs, achieves absolute repeatability in indexing, is durable, easy to install, and is aesthetically pleasing.

It is therefore a principal object of the present invention to provide a device and method which improves over or solves the problems and deficiencies existing in the art.

It is a further object of this invention to provide a device and method which firmly grips glass doors and panels.

It is a further object of this invention to provide a device and method which hinges glass panels in a way that permits for a wide range of rotation with absolute repeatability in indexing.

It is a further object of this invention to provide a device and method which minimizes structural flaws.

It is a further object of this invention to provide a device and method which deters the loosening of the wall plate screws when a glass panel is hinged on a wall.

It is a further object of this invention to provide a device and method that is aesthetically pleasing so as to compliment its environment.

It is a further object of this invention to provide a device and method that minimizes fabrication and installation costs.

It is a further object of this invention to provide a device and method that is durable.

These and other objects and advantages of the invention will become apparent to those skilled in the art with reference to the accompanying claims and specification.

SUMMARY OF THE INVENTION

This invention relates to a device and method of hinging a glass door or panel on an adjoining wall, either glass or non-glass. The former uses a glass-to-glass clamp, the latter usually uses a base plate for attachment to the non-glass wall.

The invention includes as a feature an actuating mechanism that allows for a smooth, controlled, sturdy rotation with indexing to a preselected position. The invention features consistent and reliable return to an original position (i.e., absolute repeatability). The actuating mechanism utilizes a main pivot roller that incorporates at least one indexing detent along its centerline. A spring loaded sub pin roller rotates about the periphery of the main pivot roller providing a consistent index at each detent.

Another aspect of this invention obviates the need for fabricating glass with holes by providing as a feature a friction clamping device that clamps the glass between two surfaces lined with flexible gaskets. The glass is secured by flexible gaskets, positioned in machined gasket pockets, that swell laterally, but then are restricted form further lateral swelling by the gasket pockets, as pressure is applied. The flexible gaskets and gasket pockets improve the grip of the clamp without applying additional torque to the clamp screws.

The invention is easy to install, is economical, is durable, can be utilized in a variety of embodiments, and does not subtract from the aesthetic appeal of its environment.

DETAILED DESCRIPTION OF THE PREFERRED EMBODIMENT

Figure 1:
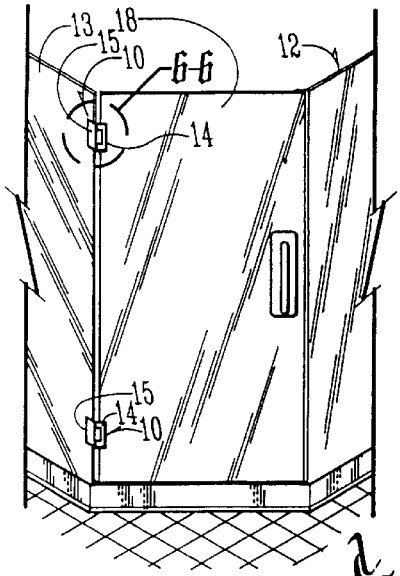
FIG. 1 is a perspective view of one embodiment of a hinge according to the present invention used with a substantially frameless all-glass shower enclosure.

With reference to the accompanying drawings, a detailed description of a preferred embodiment of the present invention will now be set forth. This description is intended to aid in an understanding of the invention, but does not limit the invention, which is defined solely by the claims following the description.

Reference numerals are utilized to designate certain parts and features in the drawings. Like reference numerals will be utilized to designate like parts throughout the drawings, unless otherwise indicated.

FIG. 1 illustrates hinge 10 according to the invention as used with a framed shower glass enclosure (designated generally at 12). This embodiment 10 of the invention utilizes oppositely disposed glass-to-glass clamps 15 and 14 to grip fixed glass panel 13 (for example ⅜"×½" tempered or laminated glass) and pivotable glass door 18 respectively. There is no frame surrounding the adjacent edges of panel 13 and panel 18, so hinge 10 must effectively attach to those glass panels to provide a reliable, durable, and repeatable hinge function for door 18. In FIG. 1, two hinges 10 are used. Other numbers are possible.

Figure 2:
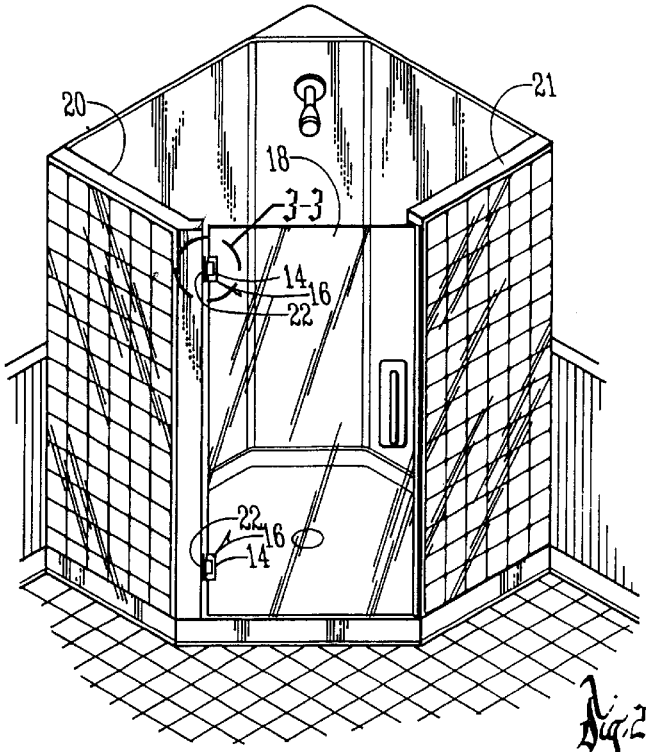
FIG. 2 is a perspective view of another embodiment of a hinge according to the present invention mounting a glass panel to a non-glass wall.

FIG. 2 illustrates an alternative embodiment of a hinge of the invention (namely hinge 16), hinging a glass panel door 18 and a non-glass wall 20. This embodiment utilizes a base plate 22 to mount hinge 16 to wall 20. Wall 21 on the opposite side of door 18 from hinges 16 (two hinges 16 are used in FIG. 2), can be a glass wall or a non-glass wall. Embodiment 16, like hinge 10, also utilizes glass clamp 14 to grip door 18. Base plate 22 is a plate which can be screwed, bolted, or otherwise secured to wall 20, instead of glass to glass clamp 15 of hinge 10.

Note that in FIG. 1, panel 13 is at an angle to door 18 when it is closed. For simplicity of description and illustration, in the remainder of this description and drawings, the structure and operation of either hinge 10 or 16 will be with regard to a glass panel 13 or a wall 20 which is generally co-planar with door 18 when door 18 is in a closed position. One skilled in the art will easily understand that the same principles can be applied for hinges 10 or 16 no matter what angular relationship exists between the supporting panel or wall and the pivoting door.

Figure 3:
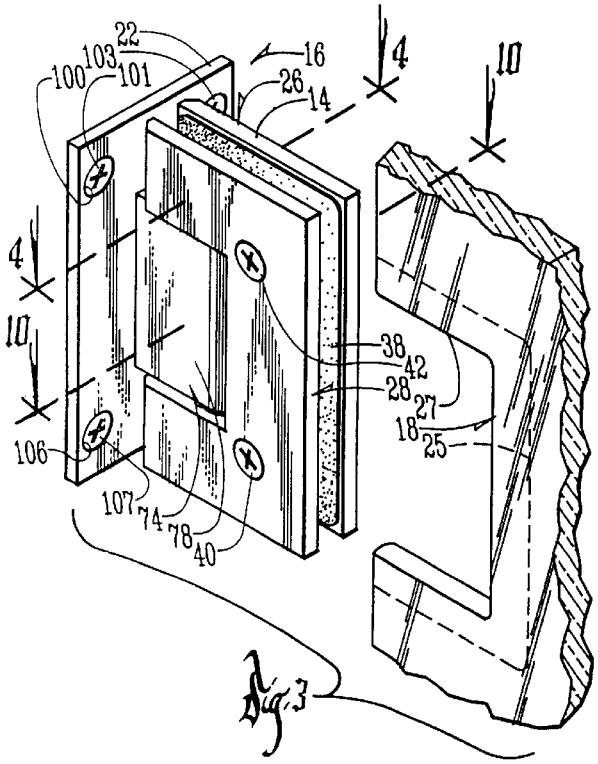
FIG. 3 is an enlarged perspective view of the hinge according to the preferred embodiment of the invention shown in FIG. 2, but showing the glass door exploded from the hinge.
Figure 4:
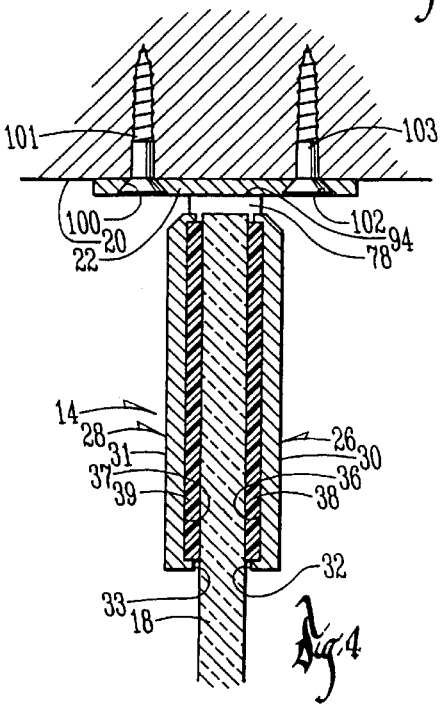
FIG. 4 is a sectional view taken along line 4—4 of FIG. 3.
Figure 5:
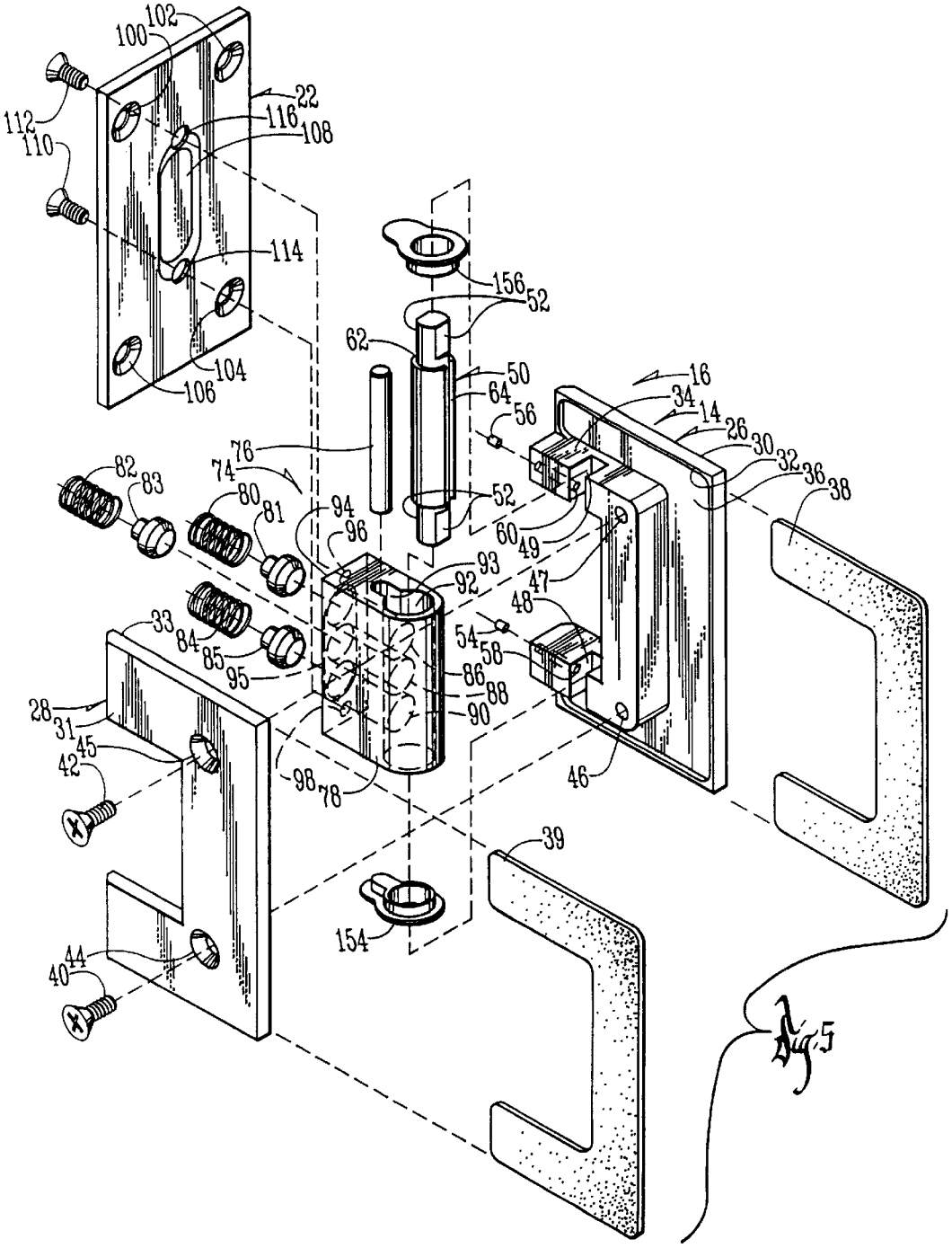
FIG. 5 is an exploded view of the hinge of FIGS. 3 and 4.

FIGS. 3–5 show in enlarged form a preferred embodiment of hinge 16 of FIG. 2. What is called a tram body 78 is secured by screws 110, 112 to base plate 22 through apertures 114, 116 in base plate 22 (see FIG. 5). Apertures 100, 102, 104, 106 in base plate 22 allow screws 101, 103, 105, 107 or other fastening mechanisms to be inserted through base plate 22 to attach base plate 22 to wall 20 or other supporting structure.

As will be explained in more detail later, tram body 78 houses components which allow and control smooth pivoting of glass panel door 18 (shown in exploded form from glass clamp 14 in FIG. 3) and also has a feature which allows for indexing of that door.

FIGS. 3 and 4 show that door 18 is gripped by glass clamp 14 consisting of glass clamp body 26 and a cover plate 28, each having a rectangular C-shape to accommodate tram body 78. Glass clamp body 26 and cover plate 28 cooperate (with screws 40 and 42) to sandwich a portion of glass door 18 and to grip glass door 18 securely enough that it is rigidly and securely held in place. It is to be understood that with respect to this embodiment, a rectangular notch 27 is precut in the glass panel door 18 for each hinge so that there is basically a C-shaped margin area (between notch 27 and dashed line 25 in FIG. 3) that is sandwiched between clamp body 26 and cover plate 28. This allows glass clamps 14 to bear the weight of the glass panel 18 and prevents vertical movement of the door relative to glass clamps 14.

FIG. 4 specifically shows in cross-section the configuration of hinge 16 of FIG. 3 including gaskets 38 and 39 which interface the opposite sides of glass door 18 and are sandwiched between glass clamp body 26 and door 18, and cover plate 28 and door 18, respectively.

Referring also to FIG. 5, it can be seen that glass clamp body 26 has an outer surface 30, a clamping surface 32, and a connecting platform 34. A recessed gasket pocket 36, here similar in shape to the glass clamp body 26, is machined into the clamping surface 32. Flexible gasket 38, when positioned in the gasket pocket 36, extends above the clamping surface 32 of glass clamp body 26.

Similar to glass clamp body 26, cover plate 28 has an outer surface 31, a clamping surface 33 and a gasket pocket 37 (see FIG. 4). A flexible gasket 39 is positioned in the gasket pocket 37. When assembled, cover plate 28 matingly fits around connecting platform 34 of glass clamp body 26 so that clamping surfaces 32 and 33 face one another and are generally aligned and parallel. Connecting platform 34 has outer dimensions which fit within notch 27 in door 18 in closely mating fashion.

A friction clamping method is used to clamp glass door 18 between the two surfaces 32 and 33 of glass clamp body 26 and cover plate 28. Gaskets 38 and 39 are 3/32" thick, 60 durometer, neoprene gaskets recessed in gasket pockets 36 and 37 (0.065" deep).

Glass clamp body 26 and cover plate 28 are, in the preferred embodiment, full machined from 385 CDA. Machining consists of the gasket pockets as well as the ¼" 20 drilled and tapped holes 44, 45 to accommodate the cover plate screws 40,42. Screws 40 and 42 pass through holes 44 and 45 and thread into holes 46 and 47 of body 26 to secure the cover plate 28 to the glass clamp body 26. When screws 40 and 42 (2¼ 20 phillips head machine screws) are tightened to bring the two sides of the clamp together, flexible gaskets 38 and 39 first swell laterally to fill any excess area in the gasket pockets 36 and 37. Once a gasket fits the area of the gasket pocket 36 or 37, all additional forces applied are transmitted to the glass face (of door 18) being clamped, effectively prohibiting any slippage of glass clamp body 26 or cover plate 28.

The attachment of hinge 16 to wall 20 and door 18 has now been described. Following is a description of the hinging mechanism.

Spring tram body 78 is rigidly mounted to base plate 22. Glass clamp 14 is pivotably attached to the tram body 78 and its interior contents.

FIG. 5 shows in detail how base plate 22 is machined to receive screws 101, 103, 105, 107 (#10 wood screws) in holes 100, 102, 104, 106 for mounting the base plate 22 to a non-glass wall 20. Base plate 22 is 2" by 3¾" by 3/16" (GWH 100) or 2" by 2⅜" by 3/16" (GWH 101) CDA 385. FIG. 5 also shows how base 94 of tram body 78 is secured to the base plate 22 by screws 110 and 112 (#10 machine screws) that pass through holes 114 and 116 on the base plate and thread into drilled and tapped #10-24 holes 96 and 98 on the tram body.

Note that the base 94 of the tram body 78 has tapped holes 96 and 98 to secure the tram body 78 to either a base plate 22 or a glass-to-glass clamp body 15 (described later). The base 94 has a machined mating surface 95 (see FIG. 10), which is raised 0.050" with the perimeter machined at approximately 30 degrees taper for mounting the tram body 78 to either base plate 22 or glass-to-glass clamp 15 (see, for example, mating pocket 108 in base plate 22). The tapered designs of the mating pocket 108 and mating surface 95 helps to eliminate, during rotation of the glass clamp 14, rocking motion and loosening of screws 101, 103, 105, 107, 110 and 112 under a radial load as is typical with flat base designs.

The main pivot roller 50, as shown in FIG. 5, is one component of an actuating mechanism 74 housed in tram body 78. Both ends of the main pivot roller 50 (0.4270"× 2.875" OAL) are machined with anchor flats 52 on both sides. In the preferred embodiment main pivot roller 50 is 2.5" in length and is stainless steel that is turned, ground and polished. The length of each anchor flat is 0.375" and the length of each detent 62 or 64 is 1.55".

Aligned 0.250" slots 48 and 49, machined in the connecting platform 34 of glass clamp body 26 at 90 degrees to the clamping surface 32, matingly receive the ends of main pivot roller 50 in proper orientation. The anchor flats 52 rest adjacent and parallel to the facing walls of slots 48 and 49. Set screws 54 and 56 (#8-32) thread through drilled in #8-32 tapped holes 58 and 60, normal to the anchor flats 52. When tightened, screws 54 and 56 abut the anchor flats 52 to secure the main pivot roller 50 into position. In other words, main pivot roller 50 will rotate with door 18 about a pivot axis through it—thus it essentially is the pivot pin for the hinge.

The tram body 78 houses the main pivot roller 50 in a drilled and reamed 0.4385" bore 92 at the centerline of and extending through tram body 78. A sub pin roller 76, housed in a duct 93 (parallel to to and in communication with bore 92 along their lengths), rolls about the periphery of the main pivot roller 50 when it pivots with door 18 (see, for example, FIG. 11). Sub pin roller is a 0.1870" by 1.625" stainless steel turned, ground, and polished piece. Flexible washers 154 and 156 fit around the main pivot roller 50 and around the end of the sub pin roller 70, between the tram body 78 and glass clamp 24. Main pivot roller 50 and sub pin roller 76 are captured in place by connecting platform 34 when hinge 16 is assembled.

Three ⅜" holes (3⅜ 0) 86, 88, and 90 are blind drilled into the duct 93 at 90 degrees to duct 93 from the bottom or base 94 of spring tram body 78. Coil springs 80, 82, and 84 are housed inside holes 86, 88, 90 of tram body 78. Spring pads 81, 83, and 85 are fixed to the ends of springs 80, 82, and 84. When hinge 16 is assembled, springs 80, 82, 84 bias spring pads 81, 83, 85 against the side of sub pin roller 68.

Figure 10:
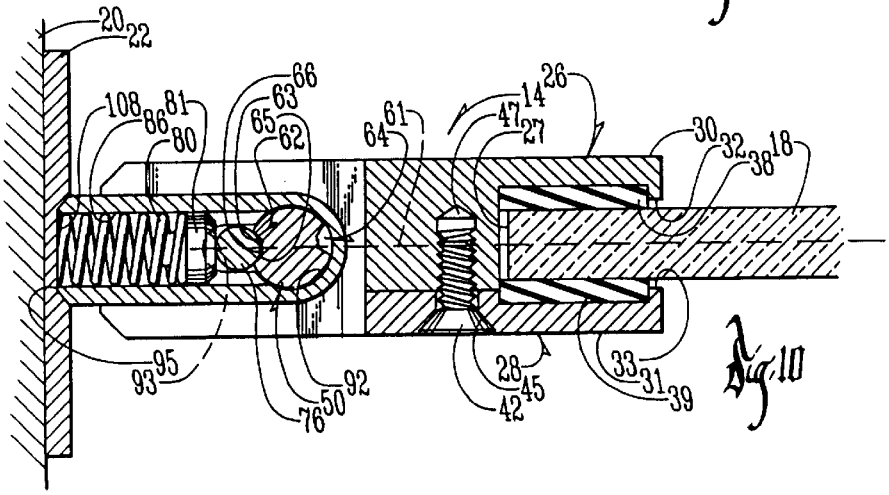
FIG. 10 shows that the glass panel and hinge in the closed or at rest position of FIG. 9, but in enlarged cross-section generally along line 10—10 of FIG. 3.

FIG. 5 shows that two 90 degree V-type detents 62 and 64 are located down the center line on opposite sides of the main pivot roller 50 (see also FIG. 10). Detents 62 and 64 represent alternative indexing positions. As the glass clamp 14 rotates about its axis, the sub pin roller 76 rotates smoothly about the periphery of main pivot roller 50, riding in five journals in tram body 78. When the sub pin roller 76 reaches detent 62 or 64, the springs 80, 82 and 84 exert pressure on the sub pin roller 76 forcing it into the detent 62 or 64, effectively indexing the glass clamp 24 at indexing position # 1 or indexing position # 2.

Figure 6:
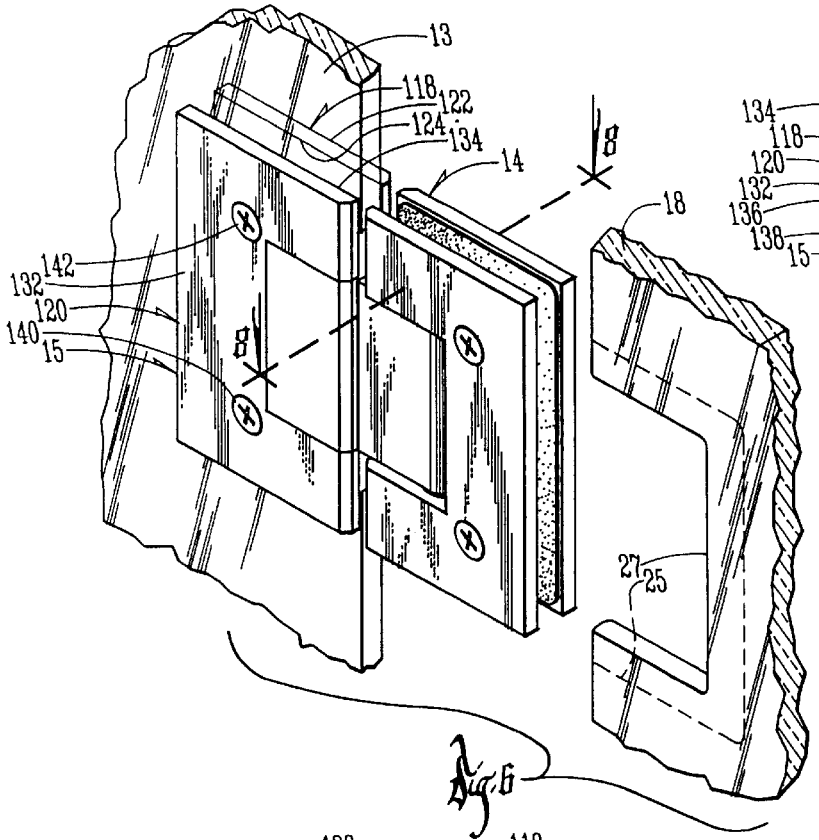
FIG. 6 is a enlarged perspective view of the alternative embodiment of a hinge according to the present invention shown in FIG. 1 attached between a pivotable glass panel and a stationary glass panel, but showing the glass door exploded form the hinge.
Figure 8:
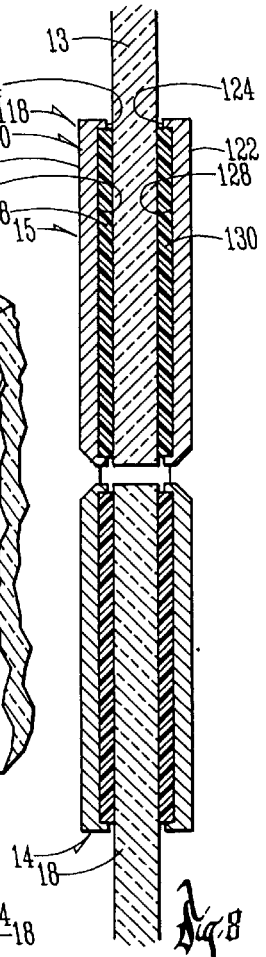
FIG. 8 is a sectional view taken along line 8—8 of FIG. 6.
Figure 7:
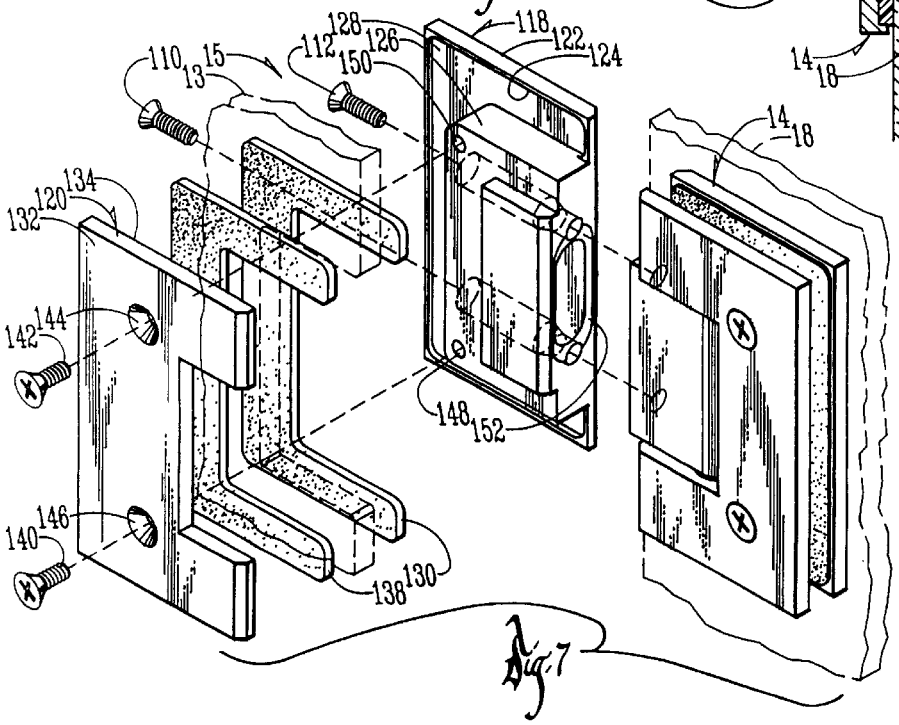
FIG. 7 is a partially exploded perspective view of the hinge of FIG. 6.

FIGS. 6–8 depict in detail the alternative embodiment hinge 10 according to the present invention. When a glass panel door 18 is hinged to a glass panel wall 13, the invention utilizes a glass-to-glass hinge 10. Hinge 10 uses the same glass clamp 14 as hinge 16 to clamp hinge 10 to glass panel door 18. Additionally, the tram body 78 and the internal contents are the same as previously described. The only difference is that instead of base plate 22, a glass-to-glass clamp 15 clamps hinge 10 to the glass panel wall 13 between a glass-to-glass clamp body 118 and a cover plate 120.

By referring to FIGS. 7 and 8, the particular structure of glass-to-glass clamp 15 can be seen in more detail. The glass-to-glass clamp body 118 (full machined 385 CDA) has an outer surface 122, clamping surface 124, and a connecting platform 126. A flat gasket pocket 128 is recessed into the clamping surface 124. A flexible gasket 130, positioned in the gasket pocket 128, extends above the clamping surface 124. This structure is similar to clamp body 26 previously described.

Similar in perimeter shape to the glass-to-glass clamp body 118, the cover plate 120 (full machined 385 CDA) has an outer surface 132, clamping surface 134, and gasket pocket 136 (see FIG. 8). A flexible gasket 138 is positioned in the gasket pocket 136 (0.065" deep). The clamping surface 134 of the cover plate 120 abuts the connecting platform 126 of the glass-to-glass clamp body 118 so that the clamping surfaces 124 and 134 face and are parallel. By referring to FIG. 7 it can be seen that screws 140 and 142 fasten the glass-to-glass clamp body 118 and cover plate 120 by passing through holes 144 and 146 in the cover plate and into holes 148 and 150 in the glass-to-glass clamp body. Mating pocket 152 of the glass-to-glass clamp body is machined to accept the mating surface 95 (as previously explained) of the tram body 78.

The glass panel wall 13, having a rectangular cut-out (not shown) like notch 27 in door 18, is positioned between the clamping surfaces 124 and 134. When screws 140 and 142 (2¼-20 phillips head machine screws) are tightened, the flexible gaskets 130 and 138 (3/32" thick 60 durometer neoprene) swell laterally to fill any excess area in the gasket pockets 128 and 136 and grip the glass 18 as previously described.

Machining consists of gasket pockets 128 and 136 as well as the ¼-20 drilled in, tapped holes 144 and 146 to receive the cover plate screws in clamp body 118. Glass-to-glass clamp body 118 is machined for two #10-24×2 round head machine screws 110 and 112 and is machined (at reference #152) to accept the 30° by 0.050" milling (at reference #95) of tram body 78.

Using pressure to secure the glass door 18 in both hinge embodiments 10 and 16 obviates the need for drilling holes into the glass. As a result, fabrication and installation costs are minimized because less accuracy is required.

The indexing and operation of the preferred embodiment will now be described in more detail by referring particularly to FIGS. 9–15. Detents are alternatives to index the glass clamp 14. Indexing detent #1 (groove 62) is at 90 degrees to the anchor flats 52 (shown in FIG. 5) to achieve indexing at the at rest or closed door position of the glass clamp 14 (this will be further described later). Indexing detent #2 (groove 64) is at 77 degrees clockwise to indexing detent #1. Indexing position #2 can be used to over-index the glass clamp 24 in an open position past the at rest or closed door position (this will be further described).

Figure 9:
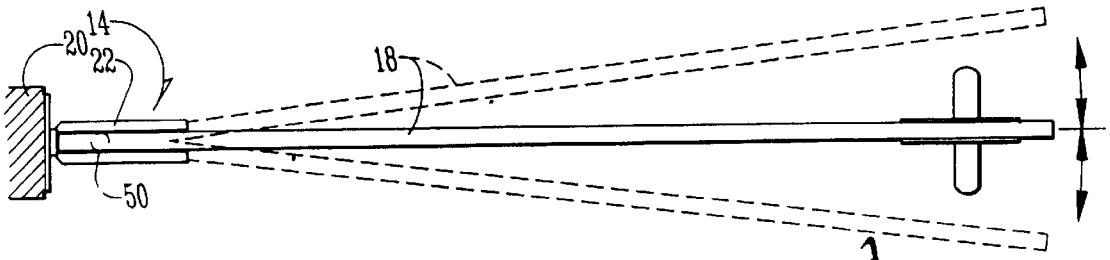
FIG. 9 is a top plan view of the hinge of FIGS. 3–5 and associated pivotable glass panel showing in solid lines a first indexing position with the glass panel in the at rest or closed position, and diagrammatically showing in dashed lines the ability of the door to move away from the closed position to other positions.

FIG. 9 is a top plan diagrammatic depiction of hinge 10 and glass door 18. In this position, door 18 is shown in solid lines in the at rest or closed position (directly along axis 61) when sub pin roller 76 is in detent 62 (see FIG. 10). Therefore, positive indexing is achieved when door 18 is in the closed position.

Figure 11:
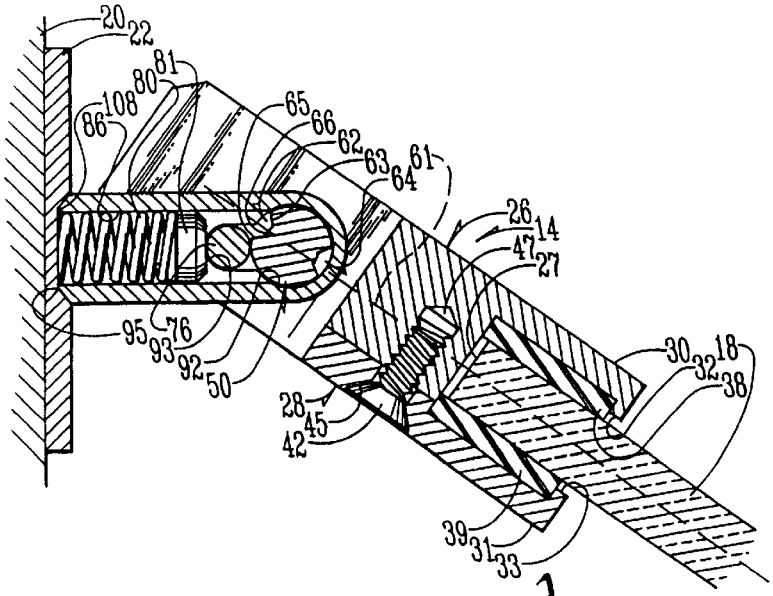
FIG. 11 is similar to FIG. 10 but shows the glass panel moved away from the closed or at rest position.

FIG. 9 illustrates that if needed, door 18 could be pivoted in an opposite direction from line 61 to that shown in FIG. 11 (upwardly in FIG. 9). It is to be understood that it is essentially impossible for door 18 to be rotated far enough that it will cause detent 64 to come into play if detent 62 is originally positioned to line up with sub pin roller 76 when door 18 is in a closed position and if detent 64 is essentially opposite detent 62. However, detents could be positioned at any location around roller 50. It is possible that two detents could be made to come into play.

Figure 15:
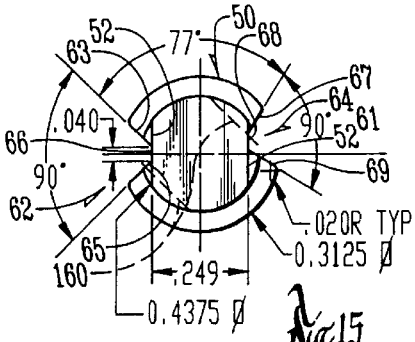
FIG. 15 is an enlarged end plan view of the main pivot roller according to a preferred embodiment of the invention.

FIGS. 10, 11 and 15 show with specificity the exact nature of detents 62 and 64. It can be seen that both detents 62 and 64 have flat bottoms (0.040"). Note that detent 62 is symmetrical about the plane indicated by dashed line 61 (an edge view of the plane which extends along the center longitudinal axis of main pivot roller 50). The side walls 63 and 65 of detent 62 are basically angled at 45° from plane 61, making the angle between the opposite sides 63 and 65 a total of 90°.

In comparison, detent 64 is shifted off of the center plane 61 so that bottom 68 of detent 64 is almost entirely to one side of plane 61. While the angle formed between side walls 67 and 69 of detent 64 also is 90°, the offset of detent 64 from plane 61 makes wall 67 essentially 77° away from the wall 63 of detent 62 (see FIG. 15). As previously stated, main pivot roller 50 is inserted in tram body 78 in the fashion shown in FIGS. 10 and 11 so that detent 62 is operative with sub pin roller 76 if it is desired to have a positive index for glass door 18 directly parallel with plane 61 (as shown in FIG. 10). On the other hand, main pivot roller 50 can be reversed in tram body 78 in the fashion shown in FIGS. 13 and 14 so that sub pin roller 76 comes into play with detent 64 if it is desired to over-index the glass door 18 past plane 61.

FIG. 15 shows the exact structure of both detents 62 and 64 and includes dimensions according to the preferred embodiment. Anchor flats 52 are shown. It is to be understood that if a different indexing position was desired all that would have to be done is to change the angular relationship between the anchor flats 52 and detents 62 or 64 (see, for example, FIGS. 16–19). Also, the size, number, and position of detents 64 can be selected for different indexing positions, different sub pin rollers, and other results, as can be appreciated. For example, wall 13 in FIG. 1 might be 135 degrees from the plane of door 18 when it is closed. By forming anchor flats 52 at 45 degrees (instead of at 90 degrees) from a detent (see dashed lines 160 in FIG. 15), a positive index will be created for door 18 in a closed position 135 degrees relative to wall 13.

By referring to FIGS. 10 and 11, and 13 and 14, it can be seen that the sub pin roller 76 rides in duct 93. When in use sub pin roller 76 is capped off at opposite ends by washers 154 and 156 (see FIG. 5). The three springs 80, 82, 84 that provide pressure against the side of sub pin roller 76 are 0.375" by 0.500" stainless steel coil springs with 0.375" by 0.130" nylon wear pads 81, 83, 85. As the hinge rotates about its axis, sub pin roller 76 rotates about main pivot roller 50. When main pivot roller 50 reaches a detent, the pre-loaded springs exert pressure to sub pin roller 76 forcing it into a detent effectively indexing the door in the at rest or closed door position.

FIG. 10 shows the relationship of sub pin roller 76 to main pivot roller 50 when installed in tram body 78, and when sub pin roller 76 is fully in detent 62 (index position 1).

FIG. 11 shows that if door 18 is rotated out of plane 61 (downwardly in FIGS. 9 and 11), sub pin roller 76 rolls out of detent 62 (if sufficient force is exerted against door 18) and rolls along the outer rounded surface of main pivot roller 50. The exertion of the springs 80, 82, 84 on sub pin roller 76 and the rolling along main pivot roller 50, gives a smooth, even opening action for door 18.

To return door 18 to the closed position, door 18 must be pivoted back towards line 61, and then sub pin roller 76 attempt to seat in detent 64, as explained earlier.

Figure 12:
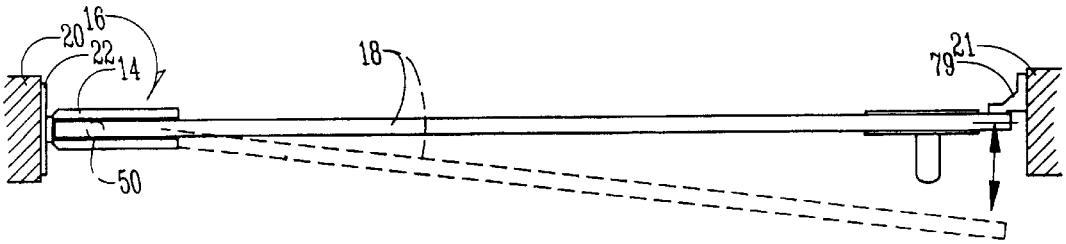
FIG. 12 is similar to FIG. 9 but shows the hinge and door in a second indexing position in a closed or at rest position against a door jamb.
Figure 13:
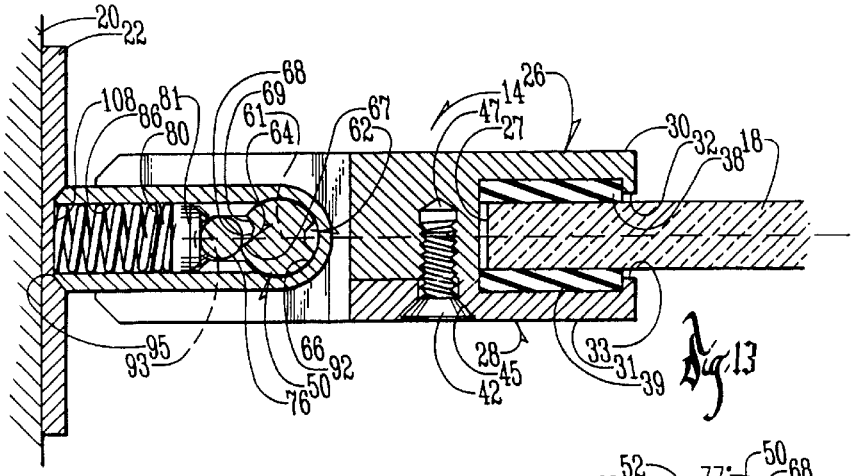
FIG. 13 is similar to FIG. 10 but shows the glass panel in the closed or at rest position with respect to the second indexing position of the hinge.
Figure 14:
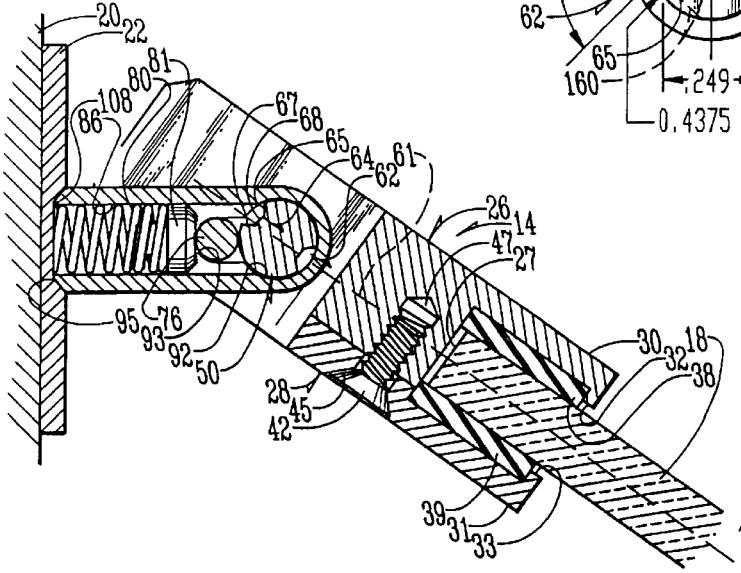
FIG. 14 is similar to FIG. 11 showing the glass panel moved away from the closed or at rest position, but with respect to the second indexing configuration of the hinge.
Figure 16:
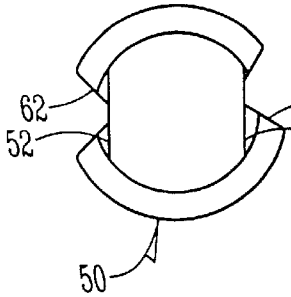
FIGS. 16–19 are similar to FIG. 15 but show alternative embodiments of the main pivot roller.
Figure 17:
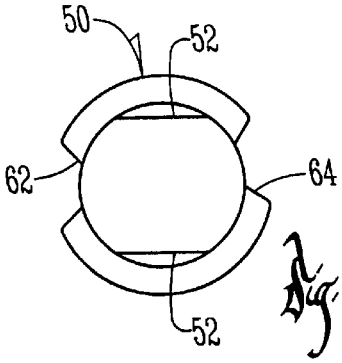
Figure 18:
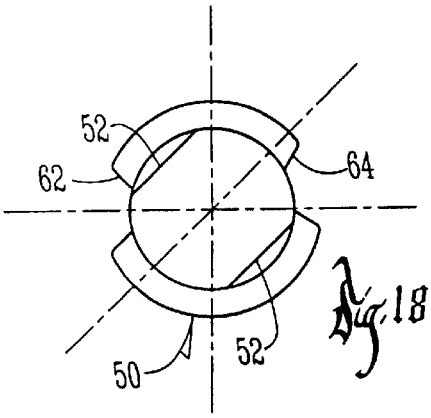
Figure 19:
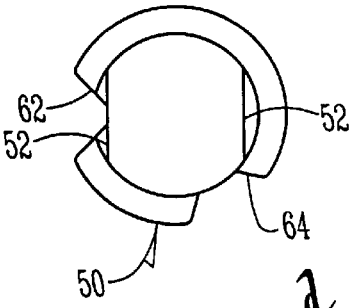

As illustrated in FIGS. 12–14, detent 64 can be used as an indexing detent by simply removing main pivot roller 50 from tram housing 78 and reinserting it to align detent 64 with sub pin roller 76 when door 18 is basically in the closed position (see FIG. 12 (door in solid lines) and FIG. 13). As can be seen, ramp 67 abuts sub pin roller 76 and tries to rotate main pivot roller 50 in a counter clockwise direction. Therefore, if door 18 closes against a mechanical stop (79 in FIG. 12) that is basically along line 61, detent 64 requires main pivot roller 50 to actually over-index past line 61 to allow sub pin roller 76 to fully seat in detent 64. Therefore, door 18 will be forced against the mechanical stop (such as a seal) which is desired in some instances. FIG. 14 simply shows, like FIG. 11, that if door 18 is rotated with sufficient force, main pivot roller 50 will rotate so that sub pin roller 76 leaves detent 64 and rolls along the perimeter side wall of main pivot roller 50.

One example of when over-indexing would be beneficial is where installation dictates that a seal be used at the jamb side of the door and the door is stopped at the at rest, closed position either by a mechanical stop or, for example, by mitered overlapping glass panel edges (see for example seal 79 in FIG. 12). In this case, sub pin rollers 76 would be along plane 61 when the door is brought to the at rest, closed position (see FIG. 13). However, because detent 64 is offset, wall 67 of detent 64 would urge sub pin roller 76 to move towards the center of detent 64 to the right of plane 61 (see FIG. 13). This urging by wall or ramp 67 effectively applies pressure to the mechanical stop or seal 79 placed at the jamb side of the door to hold that side of the door in a sealed and closed position.

Although this invention may be made from a variety of materials using various methods, it is preferred that the invention be machined from stainless steel billet bar stock. Machining the components of the present invention from bar stock eliminates grain structure flaws resulting from flow control problems associated with forging methods. The stainless steel is also easy to maintain and can be polished to produce a device with aesthetic appeal.

The included preferred embodiment is given by way of example only, and not by way of limitation to the invention, which is solely described by the appended claims. Variations obvious to one skilled in the art will be included within the invention defined by the claims.

What is claimed is:

1. A hinge for hinging a glass panel door to an adjacent supporting structure comprising:

a tram body comprising a housing;

a main pivot roller rotatably journaled in the housing and including a main body portion and narrowed opposite end portions;

a sub pin roller rotatably journaled in the housing along the main body portion of the main pivot roller;

a biasing member positioned in the housing pushing the sub pin roller into abutment with the main body portion of the main pivot roller;

the main body portion of the main pivot roller including an indexing detent along its length into which the sub pin roller fits when in alignment, the indexing detent having angled sides and a bottom, the angled sides being spaced so that the sub-roller pin can be partially inserted into the indexing detent and contact each angled side at one point;

a connector member attached to the tram body and having a component allowing connection of the hinge to an adjacent supporting structure;

the opposite end portions each including an anchor portion having a pair of oppositely facing flat surfaces, of the main pivot roller extending outwardly of the tram body housing; and a clamp comprising first and second clamp halves which are adjustable to pull the clamp halves toward one another to clamp the glass panel doors, and receiver members to receive the anchor portions of the opposite end portions of the main pivot roller to prevent rotation or movement of the main pivot roller relative to the clamp.

2. The hinge of claim 1 wherein the main pivot roller has two or more indexing detents along its length.

3. The hinge of claim 1 wherein the clamp halves include recesses to receive gaskets.

4. The hinge of claim 1 wherein the connector member is a base plate which is connectable to the tram body, the base plate having apertures to allow it to be attached to the adjacent supporting structure by mounting members.

5. The hinge of claim 1 wherein the adjacent supporting structure is a glass panel and the connector member is a second clamp attached to the tram body to attach the tram body to the glass panel.

6. The hinge of claim 1 further comprising a raised portion on one of the connector member and the tram body, and a mating recess for the raised portion on the other of the connector member and the tram body, so that attachment of the connector member and the tram body resists rocking during operation of the hinge.

7. The apparatus of claim 1 further comprising the angles walls of the indexing detent are at or near ninety degrees relative to one another.

8. The apparatus of claim 1 wherein the indexing position is determined by the relationship of the flat surfaces of the anchor portions of the opposite ends of the main roller pin relative to the position of the indexing detent around the circumference of the main roller pin.

9. The apparatus of claim 8 wherein the indexing detent is either in alignment with the anchor flat surfaces of the portions or at ninety degrees to the flat surfaces of the anchor portions.

10. The apparatus of claim 8 wherein the indexing detent is neither aligned with the flat surfaces of the anchor portions nor at ninety degrees to the flat surfaces of the anchor portions.

11. The apparatus of claim 10 wherein the indexing detent is about 45 degrees offset from either alignment with the flat surfaces of the anchor portions or from ninety degrees to the flat surfaces of the anchor portions.

12. The apparatus of claim 8 wherein the indexing detent is positioned on the main pivot pin slightly beyond a position in alignment with a closed position for the hinge to over-index the hinge so that a glass door can be urged against a door stop or jam by the hinge.

13. The apparatus of claim 1 further comprising a second indexing detent on the main pivot pin.

14. The apparatus of claim 13 wherein the second indexing detent positioned along the main pivot pin at other than 180 degrees from the first indexing detent.

15. A hinge mechanism for pivotable attachment of a first member to a second member comprising:

a housing mountable to the second member;

first and second pins positioned generally side by side within the housing;

a biasing member to force the first pin into abutment with the second pin so that rotation of the second pin results in movement of the first pin across the surface of the second pin;

an indexing detent along the second pin, the indexing detent having a v-shape with inwardly angled opposite walls, the indexing detent defining an indexing position for the first member relative to the second member when the second pin is rotated to a position where the first pin at least contacts one of the angled opposite walls; and the first member connected to opposite ends of the second pin.

16. A hinge for hinging a glass panel door to an adjacent wall comprising:

a tram body comprising a housing;

a main pivot roller rotatably journaled in the housing;

a sub pin roller rotatably journaled in the housing along the main pivot roller;

a biasing member pushing the sub pin roller into abutment with the main pivot roller;

the main pivot roller including an indexing detent along its length into which the sub pin roller partially fits when in alignment;

a connector member attached to the tram body allowing connection of the hinge to the adjacent wall;

a raised portion on one of the connector member and the tram body, and a mating recess for the raised portion on the other of the connector member and the tram body, so that attachment of the connector member and the tram body resists rocking during operation of the hinge;

opposite ends of the main pivot roller extending outwardly of the tram body housing; and a clamp comprising first and second clamp sides which are adjustable to pull the clamp sides toward one another to clamp the glass panel door, and receiver members to receive the opposite ends of the main pivot roller and to prevent rotation or movement of the main pivot roller relative to the clamp.

* * * * *

UNITED STATES PATENT AND TRADEMARK OFFICE

CERTIFICATE OF CORRECTION

PATENT NO. : 5,867,869
DATED : February 9, 1999
INVENTOR(S) : Garrett, et al.

It is certified that error appears in the above-identified patent and that said Letters Patent is hereby corrected as shown below:

In claim 1, column 10, line 3, please delete–[s]– from the word doors.

Signed and Sealed this

First Day of June, 1999

*Attest:*

Q. TODD DICKINSON

*Attesting Officer*

*Acting Commissioner of Patents and Trademarks*